United States Patent [19]

Barlow

[11] 4,181,253

[45] Jan. 1, 1980

[54] CEILING AIR DIFFUSER AND INDUCTION APPARATUS

[75] Inventor: Raymond S. Barlow, Plainville, Conn.

[73] Assignee: Connor Engineering & Manufacturing, Inc., Danbury, Conn.

[21] Appl. No.: 863,705

[22] Filed: Dec. 23, 1977

[51] Int. Cl.[2] ..... F24F 7/00; F24F 13/06

[52] U.S. Cl. ..... 236/49; 98/38 E; 98/40 B; 98/40 D

[58] Field of Search ..... 98/38 E, 38 D, 40 D, 98/41 SV, 40 B; 236/49, 13

[56] References Cited

U.S. PATENT DOCUMENTS

| | | | |
|---|---|---|---|
| 2,791,170 | 5/1957 | Phillips et al. | 98/40 |
| 3,026,787 | 3/1962 | De La Combe | 98/41 |
| 3,537,380 | 11/1970 | Spradling et al. | 98/40 |
| 3,732,799 | 5/1973 | Spoormaker | 98/38 |

FOREIGN PATENT DOCUMENTS

| | | | |
|---|---|---|---|
| 1047405 | 12/1958 | Fed. Rep. of Germany | 98/40 |
| 607323 | 8/1948 | United Kingdom | 98/40 |

*Primary Examiner*—William E. Wayner
*Assistant Examiner*—Harry Tanner
*Attorney, Agent, or Firm*—St. Onge, Steward, Johnston, Reens & Noe

[57] ABSTRACT

The diffuser has outwardly flared lower side walls and an upper vertical wall portion adapted to receive primary air from a supply source. The vertical portion includes a lower extension into the space defined by the lower flared side walls, and the lower extension includes vertically elongated horizontally oriented orifice openings at horizontally spaced positions therein. A damper device is provided which is adjustably positionable at different elevation positions and operable to vary the open area of the elongated orifice openings by variably masking and unmasking said openings. The air flow through the orifice openings is effective to provide induced flow of secondary air from the room.

27 Claims, 2 Drawing Figures

CEILING AIR DIFFUSER AND INDUCTION APPARATUS

This invention relates to ceiling diffusers which are useful in air conditioning and air circulating systems.

Most ceiling air diffusers to be operated as air inlets for supplying air to a room provide for delivery of the air in a pattern such that the air is caused to travel radially outwardly and substantially horizontally along the ceiling of the room. This keeps the air supplied from the diffuser, which is often cooled, from simply dropping directly downwardly from the diffuser. This serves to distribute the air and avoids causing discomfort to any occupants of the room who happen to be directly below the diffuser.

While entrainment of the room air (secondary air) by the air from the diffuser (primary air) is often accomplished, to some extent, by standard diffuser designs, a more thorough mixing of the primary and secondary air is very desirable. Such mixing provides maximum comfort to the room occupants, and provides for ease of temperature conditioning of the air by supplying a small quantity of very cool air to be mixed with the secondary room air.

For the purpose of accomplishing this mixing, many proposals have been made for the construction of induction boxes which are to be arranged in the space above the false ceiling of the room and which induce the flow of secondary air from that space into the induction box for mixing with the primary air and delivery through the diffuser.

However, it has been found to be much more desirable and economical to provide the induction of the secondary air within the diffuser itself and directly from the room, rather than providing a separate structure to allow the room air to enter the space above the false ceiling, and a separate induction box for inducing that secondary air to flow with the primary air through a standard diffuser.

Accordingly, it is one object of the present invention to provide an improved combined ceiling air diffuser and induction apparatus which causes an induced flow of secondary room air with the primary air supplied to the diffuser.

While previous attempts have been made to produce a ceiling diffuser having direct induction of secondary air from the room, such prior structures have not provided for any substantial variation in the amount of primary air supplied, or for any variation in the ratio between the primary air and the induced secondary air. It is obviously desirable to be able to vary the amount of primary air delivered, and to vary the ratio of primary and secondary air in order to control the temperature of the air within the room, or in order to vary the air delivery capabilities of the entire system to match the fresh air requirements of the system.

Accordingly, it is another object of the invention to provide a combined ceiling air diffuser and induction apparatus which provides for a variation of the ratio of primary and secondary air and for a consequent variation in the amount of primary air supplied.

Another object of the invention is to provide an induction diffuser which not only provides for induction of secondary air, but which also may provide for deodorization of at least a portion of the induced secondary air.

Still another object of the invention is to provide for an induction diffuser which may incorporate, in combination, a temperature detector and control which may be arranged to sense the temperature of the induced secondary air, and to control the operation of the diffuser in accordance with the sensed temperature.

In recent years, inexpensive fire alarm devices have become available and are in common use. Typically, these alarm systems automatically detect the presence of smoke, or other combustion products, and cause an alarm to be sounded when the level is reached which indicates the presence of a fire. These fire detector devices are commonly located on, or near the ceiling of the room in which they are installed. Unfortunately, air conditioning systems may cause the alarms to be ineffective, especially if fresh conditioned air is constantly bathing the fire detector.

Accordingly, it is another object of the present invention to provide an induction diffuser apparatus which incorporates a fire detector and which causes the fire detector to be bathed in induced secondary air to more accurately detect the presence of fire.

Other objects and advantages of the invention will be apparent from the following description and the accompanying drawings.

In carrying out the invention, there may be provided a combined ceiling air diffuser and induction apparatus comprising a housing, the lower portion of said housing comprising outwardly flared side walls having lower wall edges which at least partially define the lower portion of the diffuser, said housing including a vertical wall portion having walls extending vertically upwardly from the upper edges of said flared side walls and forming a vertical extension of said housing, the upper end of said vertical wall portion being adapted to receive primary air from an air supply source, said vertical portion including a lower extension extending into said lower portion, said extension including vertically elongated horizontally oriented orifice openings at horizontally spaced positions therein, a damper device comprising an open-ended vertically oriented sleeve member, said damper device being adjustably positionable at different elevation positions to thereby cause said sleeve member to have different elevation positions within said vertical wall portion, said damper device including a damper plate member arranged generally horizontally within the diffuser, at least one of said damper device members being operable as the vertical position of said damper device is varied to vary the open area of said elongated orifice openings by variably masking and unmasking said openings.

Figure 1:
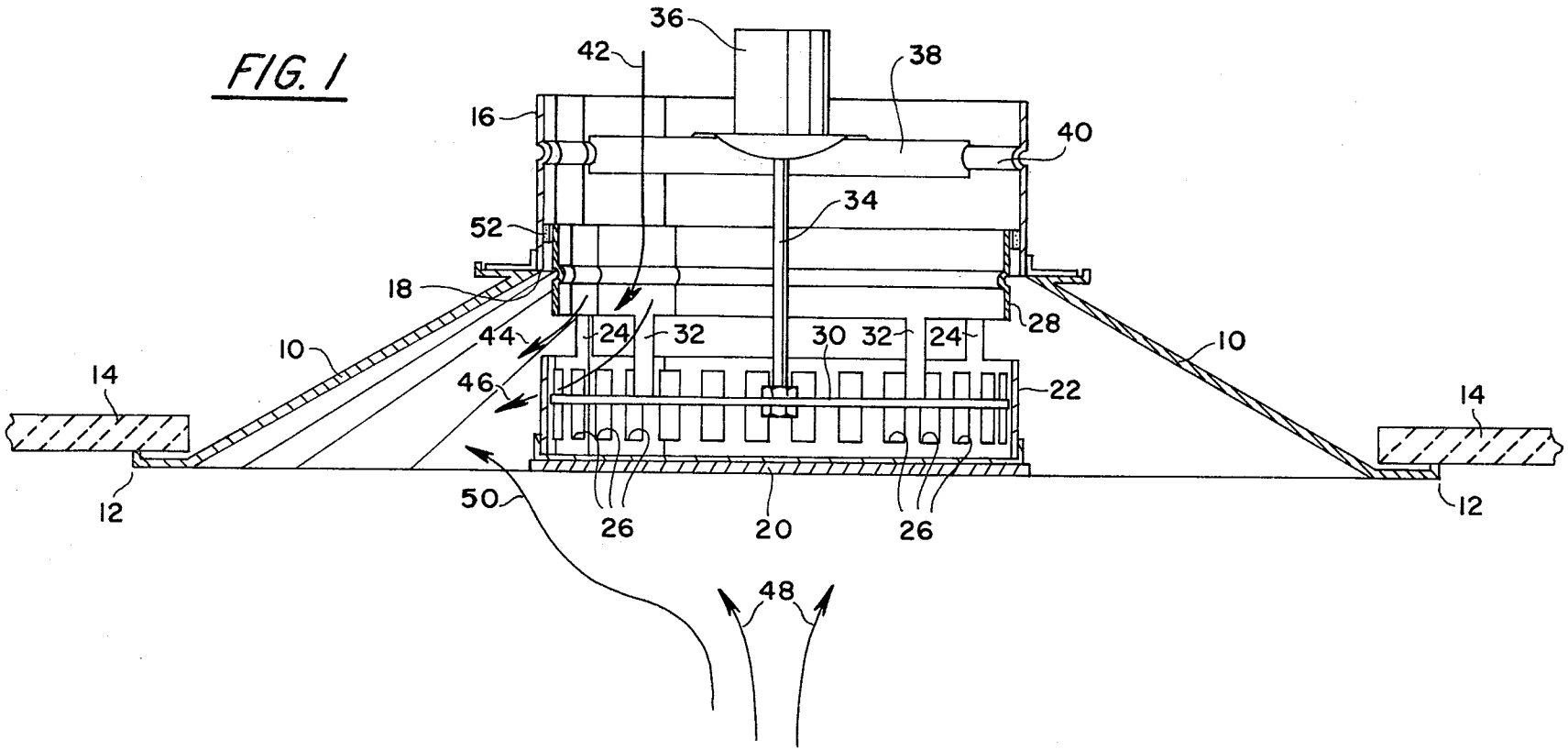
FIG. 1 is a sectional side view of a first embodiment of the subject invention.

Referring more particularly to FIG. 1, there is shown, in a sectional side view, a combined ceiling air diffuser and induction apparatus having an outer housing. The lower portion of the housing, indicated at 10, comprises outwardly flared side walls having lower wall edges at 12 which at least partially define the lower portion of the diffuser, and which do define the outer marginal edges of the diffuser. The diffuser is preferably suspended by hangers (not shown) in the space above the false ceiling of the room, and the ceiling panels 14 of the false ceiling may be fitted around the lower marginal edges 12 of the diffuser. As illustrated in FIG. 1, the diffuser is circular in design, and the outwardly flared side walls 10 form a frustum of a cone. However, it is obvious that the same design features may be incorporated in a rectangular design (including a square design).

The housing of the apparatus includes a vertical wall portion 16 having walls which extend vertically upwardly from the upper edges 18 of the flared side walls 10, and forming a vertical extension of the housing. The upper end of the vertical wall portion 16 is adapted to receive primary air from an air supply source. For this purpose, a plenum chamber with an inlet conduit connection (not shown) may be provided.

The vertical portion 16 includes a lower extension extending downwardly beneath the upper edges 18 of the flared side walls and into the space defined by the flared side walls 10. The lower extension includes a bottom wall 20 and a vertical wall portion 22 connected to the upper end of the vertical wall portion by connector straps indicated at 24.

The part 22 of the lower extension includes vertically elongated horizontally oriented orifice openings 26 at horizontally spaced positions therein.

The apparatus includes a damper device having an open ended vertically oriented sleeve member 28 and a damper plate member 30 interconnected by straplike extensions 32. The damper device 28–30 is adjustably positionable at different elevation positions to thereby cause the sleeve member to have different elevation positions within the vertical wall portions 16. For accomplishing this adjustment, a central supporting shaft 34 may be provided for the damper device which may provide an adjustable connection between a supporting structure and the damper device. Preferably, this adjustable connection is provided by a pneumatic motor 36 which may be operated to continuously adjust the vertical position of the damper device to control the primary air flow, as required. The supporting shaft 34 is therefore the operating shaft of the pneumatic motor 36. The pneumatic motor 36 and the shaft 34 are supported by means of a spider structure 38 upon the vertical wall portion 16 by means such as the inwardly extending bead 40.

As seen in the drawing, the damper plate member 30 is arranged generally horizontally within the diffuser. The vertical movement of the damper device causes the damper plate member to move up and down with relation to the elongated orifice openings 26, masking and unmasking variable portions of those orifice openings in accordance with such vertical movement.

The movement of primary air is generally directed vertically downward through the central portion of the diffuser, as indicated by the arrow 42. With the damper device in an intermediate vertical position, as illustrated in the drawing, part of the air stream 42 flows radially upwardly above the vertical part 22 of the lower extension, as indicated at 44, and part of the air stream flows through the unmasked upper portions of the elongated orifice openings 26, as indicated by the arrow 46. Thus, the upper portions of the orifice openings 26 may be said to be unmasked, and the lower portions of the orifices 26 may be said to be masked by the damper plate member 30.

The flow of air outwardly through the orifices 26, as illustrated by the arrow 46, causes an orifice effect creating low pressure areas in the vicinity of each orifice, which causes an induced flow of secondary air from the room vertically upward, as indicated by arrows 48 and 50.

As the damper device is lowered further, additional areas of the elongated orifice openings are unmasked, providing for greater primary air flow through those openings, and providing for greater induction of secondary air. At the same time, the clearance between the upper edge of the part 22 of the lower extension, and the lower edge of the sleeve member 28 decreases, thus decreasing the effective area of the open space for the discharge of primary air at 44. This decreases the total volume of primary air discharged from the diffuser. Thus, as secondary air induction increases, primary air flow decreases in volume. At the lowest position of the damper device, the plate 30 is at the bottom of the orifices 26 and the upper edge of part 22 and the lower edge of sleeve member 28 substantially meet to substantially close the radial opening therebetween to cut off the flow of air at 44.

As the damper device is raised in elevation, greater areas of the orifices 26 are masked off, and the vertical clearance between the upper edge of part 22 and the lower edge of sleeve member 28 increases, to thus increase the flow of primary air at 44, and decrease the induction at 46 and flow of secondary air at 50. In this way, at least an approximation of a constant total flow of air can be maintained from the diffuser apparatus, while varying the ratio between primary and secondary air flow.

In the embodiment illustrated in FIG. 1, the apparatus is intended to be arranged in a vertical orientation with the axis of the circular cross section device oriented vertically. Accordingly, the damper device may be said to be vertically movable on a vertical axis.

In view of the mode of operation described above, it is obvious that the vertical spacing between the marginal edges of the damper plate 30 and the lower marginal edges of the open ended cylinder member 28 must be about the same as the vertical dimension of the orifice openings 26, and preferably exceeding that dimension slightly, in order to assure a full and complete unmasking of the orifice openings 26 when the damper plate member 30 is lowered to its lowest level.

The orifice openings 26 may be designed in various different shapes to provide desired flow patterns, and to provide, if desired, for different characteristics in the change in orifice opening area versus movement of the damper plate member 30. However, the rectangular shape illustrated is preferred, and it is preferred that the orifices be evenly spaced around the circumference of the part 22, as illustrated.

As further illustrated in the drawing, the cylinder member 28 is preferably closely fitted within the cylindrical portion 16 of the housing so as to limit the leakage of primary air between the cylinder member and the cylindrical portion. Additionally, a felt gasket 52 is preferably provided between these two parts and attached to one of the parts and slidably engagable with the other one of the parts. Preferably, as illustrated, the gasket 52 is attached to the cylinder member 28, and slidably engagable with the cylindrical portion 16.

As previously described above, part 22 and interconnections 24 form and define a lower extension of the vertical portion 16 of the housing. As shown in FIG. 1, portion 16 and part 22 are both cylindrical in shape. It will be seen and appreciated from the drawings that, except for the interconnection straps 24, there is a substantially continuous radial opening between the upper margins of part 22 and the lower margins of portion 16 of the housing. The vertical (axial) dimension of that radial opening is substantially equal to the axial dimension of the orifice openings 26. This dimension generally corresponds to the total vertical travel of the damper device. Thus, the radial opening is substantially completely open when the damper device is in its uppermost position, and substantially completely closed when the damper device is in its lowermost position, the closure being accomplished by means of the cylinder member 28 of the damper device.

While only two connecting straps 24 are shown in the drawing between the upwardly extending cylindrical portion 16 of the housing and the lower extension part 22, it will be understood that four of these straps are preferably provided and evenly spaced circumferentially around the structure. Similarly, only two interconnection straps 32 are illustrated in the sectional view between the cylinder member 28 and the damper plate member 30. However, again, four straps 32 are preferably provided and evenly circumferentially spaced around the structure. While shown as rotationally separated for clarity in the drawing, the straps 32 and 24 are preferably in registration with one another so as to provide a minimum impediment to the flow of air through the radial opening between the cylindrical member 28 and the damper plate member 30. Furthermore, the straps 24 and 32 are preferably in alignment with four of the separators within part 22 between orifices 26 so that none of the orifices 26 are substantially obstructed by the strap members 32 when the damper is in the lowered position.

The bottom plate 20 of FIG. 1 is intended to be exposed to the view of the occupants of the room. Accordingly, this bottom surface is preferably decorative in nature. As indicated in the drawing, the bottom plate may have a double laminated structure with a decorative bottom plate fastened to the bottom surface of a structural bottom plate.

Figure 2:
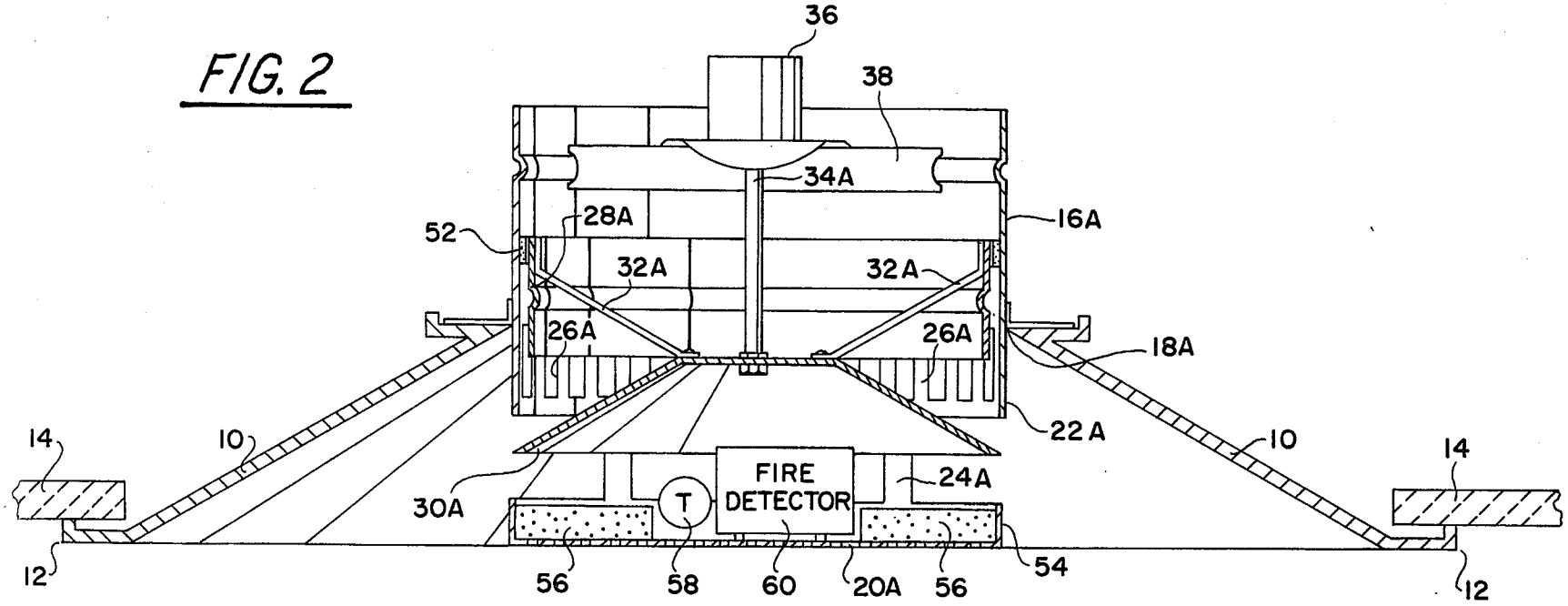
FIG. 2 is a sectional side view of a second embodiment of the invention.

FIG. 2 is a sectional side view of a modification of the invention in which parts corresponding to the embodiment of FIG. 1 are given similar number designations, with the suffix letter "A" being added when there are structural differences.

The main difference between the embodiment of FIG. 1 and the embodiment of FIG. 2 is that the part 22A of the lower extension of the cylindrical portion 16A of the housing is contiguous with the upper portion 16A of the housing, instead of being separated therefrom, and a separation is provided instead between the lower marginal edge of part 22A and the bottom 20A of the lower extension, and particularly the upper marginal edge of a lip 54 provided around the edges of the bottom plate 20A. The lip 54 and the bottom plate 20A are attached to the part 22A by means of strap members 24A. Thus, the radial and axial opening in the lower extension is positioned between the part 22A containing the radial openings 26A and the bottom wall 20A.

With this modification of structure, the functions of the two members of the damper device are reversed. That is, the cylindrical member 28A of the damper device is the one which controls the masking of the radial orifices 26A, and the damper plate member 30A of the damper device is the member which opens and closes the substantially continuous radial opening in the lower extension of the vertical housing wall portion 16A. As a consequence, the sense of operation of the pneumatic motor 36 is also reversed. In the embodiment of FIG. 1, the unmasking of the radial orifices 26 is increased, and the induction is increased, and primary air flow is reduced as the damper device is moved lower. However, these actions are all achieved in the embodiment of FIG. 2 as the damper device is moved higher.

Other differences in the embodiment of FIG. 2 include the provision of perforations in the bottom plate 20A to permit induced secondary air to flow through that bottom plate. In conjunction with this, there may be provided, just above the bottom plate, and supported upon the bottom plate cartridges 56 of material through which secondary air flow is induced for improving the quality of the air. Preferably these cartridges 56 contain particles of activated carbon which is effective to absorb odor causing materials from the air.

In accordance with another feature of the embodiment of FIG. 2, a control device 58, which is only schematically shown, may be provided just above the bottom plate 20A and supported thereon. It may consist of a control thermostat which is bathed with secondary air, and thus responds to the temperature of the secondary air from the room. The thermostat may be connected to control the pneumatic motor 36 to provide a direct control of the operation of the variable discharge diffuser. Thus, during cooling operation, when the temperature detected by thermostat 58 arises, the motor 36 is controlled to lower the damper device to increase primary air flow and to decrease secondary air induction.

In still another feature of the embodiment of FIG. 2, there may be provided a fire detector 60 which is also shown schematically, and which is positioned above the bottom plate 20A and supported thereon. The fire detector 60 is also positioned to be bathed by secondary induced air from the room and to respond to constituents of the air which indicate the presence of a fire to sound an audible alarm, or to trigger a visible alarm, or a centrally monitored alarm system. The fire detector 60 may be embodied in any one of a number of known fire detection devices including the "smoke detectors" commonly offered for installation in homes. Such detectors are commonly of the ionization type or of the photoelectric type, which are respectively responsive to an increase in ionization of air particles resulting from a nearby fire, or responsive to the presence of smoke particles from a nearby fire. Other known fire detection devices may also be used such as rate of temperature increase responsive devices.

Another feature of the FIG. 2 embodiment is that the damper plate member 30A is preferably dished in shape, as illustrated in the drawing, thus providing additional space for the activated carbon cartridges 56, the thermostat 58, and the fire detector 60. With the dish shaped damper configuration, the straps 32A connecting the damper plate 30A to the damper cylinder member 28A may each take the form, as illustrated in the drawing, of a diagonal strap attachment from the corners of the upper surface of the damper plate 30A to the upper edges of the cylinder 28A. Again, preferably four such straps are provided at evenly spaced positions around the edges of the damper device.

While the activated carbon cartridges 56, the thermostat 58, and the fire detector 60 may all be provided for in a single embodiment, as illustrated, these individual components may often be incorporated alone, and not in combination with the other components. Thus, in an embodiment incorporating the activated carbon cartridges 56, it is actually preferred to omit the other components 58 and 60, and to provide for an activated carbon cartridge 56 which extends across the entire upper surface of the perforated bottom plate 20A. Thus, a substantially larger volume of activated carbon may be provided which is more effectively in removing odor-causing materials from the air. Similarly, with fire detector 60, additional space may be required for the desired fire detector structure, and that space is desirably provided for omitting the activated carbon cartridges 56.

Alternatively, all of the components 56, 58, and 60 may be omitted from the FIG. 2 embodiment. In that instance, the FIG. 2 embodiment is still just as useful as the FIG. 1 embodiment in providing for induced flows of secondary air along with the primary air, and for concurrent variation in the volume of primary and secondary air. When the components 56, 58 and 60 are omitted from the FIG. 2 embodiment, and the additional clearance between the bottom plate 20A and the damper plate member 30A is not required for those components, then it is possible to employ the damper device of FIG. 1, having the flat damper plate 30 in the embodiment of FIG. 2. Similarly, while the FIG. 1 embodiment is not adapted to take the auxiliary components 56, 58, and 60, the damper device incorporating the dished damper plate 30A as illustrated in FIG. 2 may be employed usefully in the embodiment of FIG. 1, and operates quite effectively in the embodiment of FIG. 1. Thus, it is the outer peripheral edge of the damper plate 30, or 30A which is especially effective, in cooperation with the associated portions of the lower extension of the housing including part 22 or 22A in controlling the masking of the orifices and the opening of the substantially continuous radial opening.

As previously mentioned above, the upper end of the housing 16 of FIG. 1, and the upper end of the housing 16A of FIG. 2 are intended to be connected to a source of primary air, preferably by attachment to a plenum chamber which includes a connection to receive air from an input duct. Preferably, some means is provided for maintaining the pressure of the primary input air in the plenum chamber at a substantially constant value. With such an arrangement, the changes in the ratio of primary and secondary induced air in the apparatus of the invention is more easily predictable, and the design of the device provides the desired result with more predictability.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

I claim:

1. A combined ceiling air diffuser and induction apparatus comprising a housing, the lower portion of said housing comprising outwardly flared side walls having lower wall edges which at least partially define the lower portion of the diffuser, said housing including a vertical wall portion having walls extending vertically upwardly from the upper edges of said flared side walls and forming a vertical extension of said housing, the upper end of said vertical wall portion being adapted to receive primary air from an air supply source, said vertical portion including a lower extension extending into said lower portion, said extension including vertically elongated horizontally oriented orifice openings at horizontally spaced positions therein, a damper device comprising an open-ended vertically oriented sleeve member, said damper device being adjustably positionable at different elevation positions to thereby cause said sleeve member to have different elevation positions within said vertical wall portion, said damper device including a damper plate member arranged generally horizontally within the diffuser, at least one of said damper device members being operable as the vertical position of said damper device is varied to vary the open area of said elongated orifice openings by variably masking and unmasking said openings.

2. A combined ceiling air diffuser and induction apparatus comprising a housing, the lower portion of said housing comprising a frustum of a cone which is open at both ends and has the large diameter at the bottom to at least partially define the lower portion of the diffuser, said housing including a cylindrical portion extending upwardly from the upper edge of said frustum of a cone and forming a vertical extension of said housing, the upper end of said cylindrical portion being adapted to receive primary air from an air supply source, said cylindrical portion including a lower extension extending into said frustum of a cone, said extension including axially elongated radially oriented orifice openings at spaced positions around the circumference thereof, a damper device comprising an open-ended cylinder member, said damper device being adjustably positionable at different axial elevation positions to thereby cause said cylinder member to have different elevation positions within said cylindrical portion, said damper device including a damper plate member extending generally perpendicular to the axis of the diffuser, at least one of said damper device members being operable as the axial position of said damper device is varied to vary the open area of said elongated orifice openings by variably masking and unmasking said openings.

3. A combined apparatus as claimed in claim 2 wherein the marginal edges of said damper plate member are vertically spaced apart from the nearest adjacent marginal edges of said open ended cylinder member of said damper device by a vertical dimension generally corresponding to the axial dimension of said orifice openings, and the axial dimension of said open ended cylinder member is at least as great as the axial dimension of said orifice openings.

4. A combined apparatus as claimed in claim 2 wherein said lower extension of said cylindrical portion of said housing includes a bottom wall terminating and enclosing said lower extension.

5. A combined apparatus as claimed in claim 4 wherein said bottom wall is perforated.

6. A combined apparatus as claimed in claim 2 wherein said orifice openings in said cylindrical portion extension are substantially evenly spaced around the circumference of said extension and wherein said orifice openings are substantially rectangular in shape.

7. A combined apparatus as claimed in claim 2 wherein said open ended cylinder member of said damper device is closely fitted within said cylindrical portion of said housing to thereby limit the leakage of primary air between said cylinder member and said cylindrical portion.

8. A combined apparatus as claimed in claim 7 wherein a gasket is provided between said cylinder member and said cylindrical portion and attached to said cylinder member or to said cylindrical portion to prevent substantial leakage of primary air between said cylinder member and said cylindrical portion.

9. A combined apparatus as claimed in claim 2 wherein a pneumatic positioning motor is provided and is supported upon said housing, said pneumatic positioning motor being connected to said damper device to adjust the elevation position thereof.

10. A combined apparatus as claimed in claim 9 including in combination a temperature control device connected to control said penumatic positioning motor to adjust the position of said damper device to control the flow of primary air as a function of the temperature of the air in the room.

11. A combined apparatus as claimed in claim 3 wherein said damper plate member is positioned beneath said open ended cylinder member of said damper device.

12. A combined apparatus as claimed in claim 11 wherein said damper plate member is substantially flat in construction.

13. A combined apparatus as claimed in claim 11 wherein said damper plate member is dished in shape and arranged concave downward.

14. A combined apparatus as claimed in claim 4 wherein said lower extension of said cylindrical portion of said housing includes a substantially continuous radial opening extending over a predetermined axial dimension between the upper edge of said frustum of a cone and said bottom wall.

15. A combined apparatus as claimed in claim 14 wherein the axial dimension of said circumferential opening is substantially equal to the axial dimension of said orifice openings.

16. A combined apparatus as claimed in claim 15 wherein the part of said lower extension of said cylindrical portion containing said orifice openings is positioned adjacent to said bottom wall, and wherein said radial and axial opening in said lower extension is positioned above said last mentioned part of said lower extension containing said orifice openings, said damper plate member being operable to vary the open area of said elongated orifice openings as the axial position of said damper device is varied.

17. A combined apparatus as claimed in claim 15 wherein the part of said lower extension of said cylindrical portion containing said orifice openings is adjacent to the upper edge of said frustum of a cone and extends downwardly therefrom, and wherein said radial and axial opening in said lower extension of said cylindrical portion is positioned between said last named part containing said orifice openings and said bottom wall.

18. A combined apparatus as claimed in claim 17 wherein said bottom wall is perforated to permit the circulation of air therethrough.

19. A combined apparatus as claimed in claim 18 wherein there is provided a thermostatic element mounted within said lower extension and just above said perforated bottom wall and arranged to be bathed by room air which is induced to flow upwardly through said perforated bottom wall.

20. A combined apparatus as claimed in claim 18 wherein there is provided a fire detector mounted within said lower extension and just above said perforated bottom wall and arranged to be bathed by room air which is induced to flow upwardly through said perforated bottom wall.

21. A combined apparatus as claimed in claim 18 wherein said damper plate member is dished in shape and arranged concave downward in order to provide a substantial minimum space between said damper plate and said bottom wall.

22. A combined apparatus as claimed as claim 18 wherein there is provided a porous aggregation of activated carbon just above said perforated bottom wall and arranged to be bathed by room air induced to flow upwardly through the perforations of said bottom wall.

23. A combined apparatus as claimed in claim 22 wherein said lower extension includes a circumferential wall portion extending upwardly from said perforated bottom wall to form a lip to contain the activated carbon.

24. A combined ceiling air diffuser and induction apparatus comprising a housing, the lower portion of said housing comprising outwardly flared side walls having lower margins which at least partially define the lower portion of the diffuser, said housing including a vertical wall portion having walls extending vertically upwardly from the upper edges of said flared side walls and forming a vertical extension of said housing, the upper end of said vertical wall portion being adapted to receive primary air from an air supply source, said vertical portion including a lower extension extending into said lower portion and including a perforated bottom wall having horizontal dimensions substantially less than the dimensions between said lower margins of said flared side walls, a damper device variably positionable at different elevations above said bottom wall and operable to deflect the flow of primary air radially outwardly in a substantially horizontal direction, said damper device being operable to variably constrict the flow of primary air to provide a nozzle effect to thereby induce a vertical upward flow of secondary air from the room through said perforated bottom wall and then radially outwardly with the primary air.

25. A combined apparatus as claimed in claim 24 wherein there is provided a fire detector mounted within said lower extension and just above said perforated bottom wall and arranged to be bathed by room air which is induced to flow upwardly through said perforated bottom wall.

26. A combined apparatus as claimed in claim 24 wherein there is provided a thermostatic element mounted within said lower extension and just above said perforated bottom wall and arranged to be bathed by room air which is induced to flow upwardly through said perforated bottom wall.

27. A combined apparatus as claimed in claim 24 wherein there is provided a porous aggregation of activated carbon just above said perforated bottom wall and arranged to be bathed by room air induced to flow upwardly through the perforations of said bottom wall.

* * * * *